US009267750B1

(12) United States Patent
Tubb

(10) Patent No.: US 9,267,750 B1
(45) Date of Patent: Feb. 23, 2016

(54) DROP-IN ADJUSTABLE TRIGGER ASSEMBLY WITH CAMMING SAFETY LINKAGE

(71) Applicant: SUPERIOR SHOOTING SYSTEMS, INC, Canadian, TX (US)

(72) Inventor: George Wyatt Tubb, San Antonio, TX (US)

( * ) Notice: Subject to any disclaimer, the term of this patent is extended or adjusted under 35 U.S.C. 154(b) by 0 days.

(21) Appl. No.: 14/462,348

(22) Filed: Aug. 18, 2014

Related U.S. Application Data

(60) Provisional application No. 61/867,049, filed on Aug. 17, 2013.

(51) Int. Cl.

| | |
|---|---|
| ***F41A 19/15*** | (2006.01) |
| ***F41A 17/46*** | (2006.01) |
| ***F41A 19/06*** | (2006.01) |
| ***F41A 17/56*** | (2006.01) |
| ***F41A 19/12*** | (2006.01) |

(52) U.S. Cl.
CPC ..... *F41A 17/46* (2013.01); *F41A 17/56* (2013.01); *F41A 19/06* (2013.01); *F41A 19/12* (2013.01); *F41A 19/15* (2013.01)

(58) Field of Classification Search
CPC ..... F41A 19/10; F41A 19/12; F41A 19/15; F41A 19/16; F41A 17/56; F41A 17/62
USPC ..... 42/69.02, 70.04, 70.05
See application file for complete search history.

(56) References Cited

U.S. PATENT DOCUMENTS

| | | | | |
|---|---|---|---|---|
| 4,671,005 | A * | 6/1987 | Jewell | 42/69.02 |
| 5,615,507 | A * | 4/1997 | French | 42/69.02 |
| 2010/0175291 | A1 * | 7/2010 | Farley et al. | 42/69.01 |

* cited by examiner

*Primary Examiner* — Stephen M Johnson
(74) *Attorney, Agent, or Firm* — J. Andrew McKinney, Jr.; McKinney & Associates, LLC.

(57) ABSTRACT

A drop-in adjustable trigger assembly has a camming safety linkage to selectively move and engage a bolt sear to positively prevent movement of the bolt sear. The drop-in trigger assembly housing carries a pivoting bolt sear engagement member which is connected to a sear safety linkage. The housing has a sear safety linkage slot defined therein which guides the pivoting sear safety linkage in response to actuation of an upwardly projecting thumb safety lever's actuation. A trigger bracket preferably carries a removable, reversible trigger shoe and is configured to pivot within the housing about a pivot point within the housing, and the trigger bracket carries an adjustable rocker having (preferably) a first stage movement adjustment and a second stage length adjustment. The pivoting safety mechanism's safety linkage pivots rearwardly to push upon or cam the bolt sear upwardly, thus disengaging the bolt sear from the trigger sear.

20 Claims, 16 Drawing Sheets

SAFETY ON

SAFETY ON

SAFETY OFF

Safety On

Safety On

Safety Off

Safety Off

DROP-IN ADJUSTABLE TRIGGER ASSEMBLY WITH CAMMING SAFETY LINKAGE

The present application claims the benefit of prior Provisional Application No. 61/867,049, filed Aug. 17, 2013, the disclosure of which is hereby incorporated herein in its entirety by reference.

BACKGROUND OF THE INVENTION

1. Field of the Invention

The present invention relates to firearms and more particularly to trigger mechanisms for use in rifles and other manually actuable instruments.

2. Discussion of the Prior Art

Rifle marksmanship has been continuously developing over the last few hundred years, and now refinements in materials and manufacturing processes have made increasingly accurate aimed fire possible. These refinements have made previously ignored ergonomic or human factors more significant as sources of error.

The term "rifle" as used here, means a projectile controlling instrument or weapon configured to aim and propel or shoot a projectile, and triggers or firearm actuator systems are discussed principally with reference to their use on rifles and embodied in mechanisms commonly known as trigger assemblies. It will become apparent, however, that trigger mechanisms for manually actuable instruments may include devices other than rifles, and may be used on instruments or weapons other than rifles which are capable of controlling and propelling projectiles (e.g., rail guns or cannon). The prior art provides a richly detailed library documenting the process of improving the ergonomics of actuating rifles and other firearms (e.g., as shown in FIG. 1) and other manually actuable instruments.

Modern firearms such as rifles make use of cartridges that include a projectile seated in a casing. The casing has an internal cavity defined therein that contains a charge of rapidly combusting powder. A primer is seated in a recess formed in a rear portion of the casing. A hole in the primer casing places the primer in communication with the internal cavity containing the power. A projectile is seated in the front portion of the casing such that the powder is more or less sealingly contained in the casing between the primer and the projectile.

An action, such as a bolt action, is used to fire the cartridge. For example, the action can include a striker that carriers a firing pin. The striker can be coupled to a biasing member, such as a spring. The spring provides a motive force for the striking to cause the firing pin to impact the primer. More specifically, the spring can be compressed, or cocked, by drawing the striker rearwardly. Engagement between a sear and the striker can maintain the striker in a cocked position.

The action can then be used to advance the cartridge into a firing chamber ahead of firing. While in the firing chamber, a trigger mechanism can be used to release the sear to cause the firing pin to strike the primer, causing the primer to ignite. The ignition is directed to the powder, which burns within the casing. The powder burns within the casing to generate a rapidly expanding gas, which propels the projectile out of the casing and through the barrel.

Safety mechanisms are often used in the trigger mechanism to selectively control whether the trigger mechanism may release the sear. However, safety mechanisms may interfere with trigger feel, trigger pull or other factors which directly and adversely affect the shooter's ability to precisely control trigger actuation.

When firing a shot, a trained shooter will carefully control breathing motions, check sight alignment as part of the continuous aiming process, and then carefully squeeze the trigger to "break" the shot at a moment which is chosen by the shooter to maximize the likelihood of a "hit" on the target. The shooter's ability to repeatably and precisely execute this planned sequence of steps is determined in part by the trigger assembly's ergonomics and consistent, repeatable operation. Bad triggers exhibit uneven response to trigger finger pressure (or "creep") and do not actuate or "break" cleanly and consistently. Often, a marksman or precision shooter will struggle to adjust the performance on a trigger to maximize that specific shooter's ability to precisely control trigger actuation or "break".

Traditional rifle triggers have been categorized as single stage triggers or two stage triggers. Two-stage triggers are often used on military weapons. As the name implies, the trigger take-up is in two stages. The first stage is usually about ¼" of lighter "slack", before the second stage trigger pull begins, which ends with the trigger break. There is a difference in the weight of the trigger pull between the two stages which can be easily felt, where the first stage travel is light and the second stage requires notably greater force. A single-stage trigger does not typically have nearly as much travel as a two-stage trigger, so the shooter simply applies trigger pressure or force until the trigger breaks. Single stage triggers are more often used on sporting rifles.

Product liability lawsuits have exacerbated the shooter's ergonomics problems by forcing most manufacturers to design trigger assemblies which are nearly impossible for the shooter or user to tune or adjust. Some shooters will replace the entire trigger assembly in a rifle having a "lawyer's trigger" in the hopes of improving trigger adjustability.

There is a need, therefore, for a drop-in trigger assembly which can be used to enhance the ergonomics of trigger actuation and allow the shooter or user to tune or customize the trigger for his or her needs.

The subject matter claimed herein is not limited to embodiments that solve any of the cited disadvantages or that operate only in environments such as those described above. Rather, this background is only provided to illustrate one exemplary technology area where some examples described herein may be practiced.

SUMMARY OF THE INVENTION

Briefly, and in accordance with preferred embodiments, the present invention incorporates a drop-in adjustable trigger assembly, comprising a camming safety linkage to selectively move and engage a bolt sear. The drop-in trigger assembly has a housing having an upper portion, a lower portion, a front portion, a rear portion, a first side portion and a second side portion. The housing carries a pivoting bolt sear which is connected to a sear safety linkage. The housing has a sear safety linkage slot defined therein which guides the pivoting sear safety linkage in response to actuation of an upwardly projecting thumb safety lever's actuation. A trigger bracket preferably carries a removable trigger shoe and is configured to pivot within the housing about a pivot point positioned within the housing's lower portion. This trigger bracket carries an adjustable rocker having (preferably) a first stage movement adjustment and a second stage length adjustment. The pivoting safety mechanism's safety linkage pivots rearwardly to push upon or cam the bolt sear upwardly, thus disengaging the bolt sear from the trigger sear.

The drop-in adjustable trigger assembly of the present invention can be used to enhance the ergonomics of a rifle's trigger actuation and allows the shooter or user to tune or customize the trigger for his or her needs. The trigger assembly provides user adjustable controls for a first stage weight of pull, first stage travel or movement range, second stage break weight and second stage engagement length, each of which can be optimized separately for accurate shooting.

The trigger assembly has a camming safety linkage to selectively move and engage a bolt sear. The drop-in trigger assembly has a housing having an upper portion, a lower portion, a front portion, a rear portion, a first side portion and a second side portion. The housing includes left and right side plates which carry a pivoting bolt sear connected to a sear safety linkage. The housing's side plates have sear safety linkage slots defined therein which guide the pivoting sear safety linkage in response to actuation of an upwardly projecting thumb safety lever's actuation. A pivoting trigger bracket preferably carries a removable trigger shoe and is configured to pivot within the housing about a pivot point positioned within the housing's lower portion, the trigger bracket carries an adjustable rocker having (preferably) a first stage movement adjustment and a second stage length adjustment.

The pivoting safety mechanism's safety linkage pivots rearwardly to push upon or cam the bolt sear upwardly, thus disengaging the bolt sear from the trigger sear.

The drop-in trigger assembly of the present invention is compact and robust, due in part to the configuration of the housing's parallel, planar left side plate and right side plate which carry, orient and support the fixed and moving components of the assembly, including the pivoting safety lever which is rotatable about a transverse pin's axis from a forward "safety off" position to a rearward "safety on" position. A sear safety linkage screw transversely inserted in the safety lever drives the lower end of the elongated sear safety linkage forwardly or rearwardly in elongated housing slots and the sear safety linkage's upper end moves or pivots forwardly and up in response to safety linkage movement which terminates when the upper end of the sear safety linkage presses against and engages the bolt sear at a bolt sear lower bearing surface, thus preventing the bolt sear from pivoting under force from a bolt firing pin spring connected to the cocking piece, and disengaging the bolt sear's distal tip from the trigger sear's engagement surface.

The pivoting trigger bracket carries the adjustable transverse rocker member, which has an internal threaded bore that engages a rocker set screw to raise or lower the rocker, and the lower the rocker is positioned, the smaller the trigger's 1st stage take-up, because of an angled forward face on the pivoting trigger sear. As the transverse rocker moves down, the mechanical advantage is decreased, thus increasing the $2^{nd}$ stage weight of pull.

The housing also carries a transverse trigger sear pin which defines the pivot axis for the trigger sear. The trigger sear has a forward face on the forward side of the pivot and has its trigger sear engagement surface on the rearward side of the pivot.

When the shooter moves the pivoting safety lever from the rearward "safety on" position to the forward "safety off" position, the sear safety linkage screw drives the lower end of the sear safety linkage forward in the housing slots and the sear safety linkage's upper end pivots back and down, disengaging from the bolt sear's lower bearing surface, thus allowing the bolt sear to pivot under force from the bolt firing pin spring via the cocking piece to "reset" the bolt sear's distal tip into engagement with the trigger sear's engagement surface.

When the shooter moves the pivoting safety lever from the forward "safety off" position to the rearward "safety on" position, the sear safety linkage screw drives the lower end of the sear safety linkage rearward in the housing slots and the sear safety linkage's upper end pivots forwardly and up, pressing against and engaging the bolt sear's lower bearing surface, thus preventing the bolt sear from pivoting under force from the bolt firing pin spring via the cocking piece, and disengaging the bolt sear's distal tip from the trigger sear's engagement surface.

The trigger assembly of the present invention can also be configured as a single stage trigger, by simplifying the adjustments.

The above and still further features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF PREFERRED EMBODIMENTS

Figure 1A:
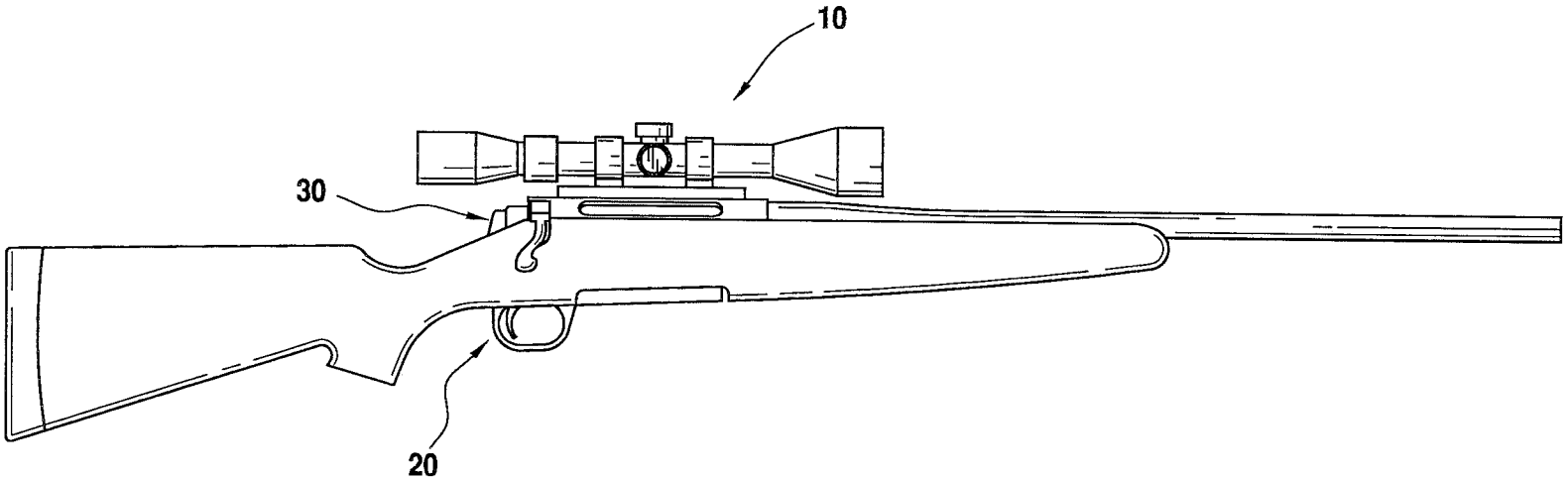
FIG. 1A Prior Art
FIGS. 1A and 1B illustrate a prior art firearm of the type which incorporates a trigger assembly of the general type provided by the present invention.
Figure 1B:
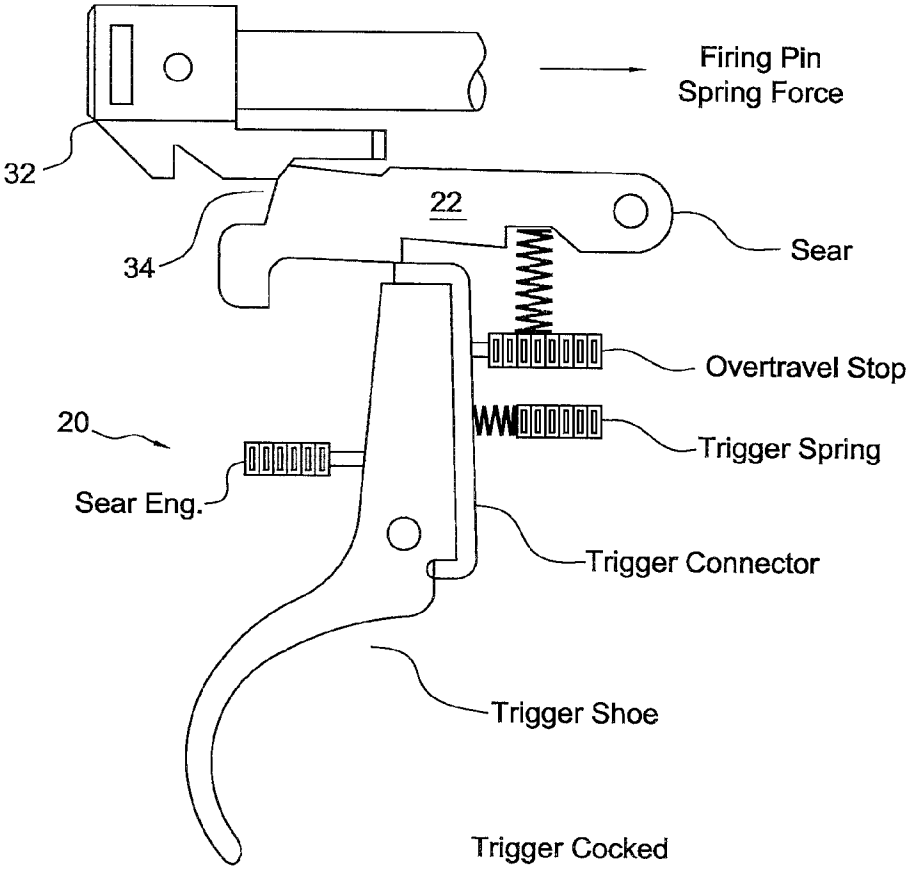
FIG. 1B Prior Art
Figure 4:
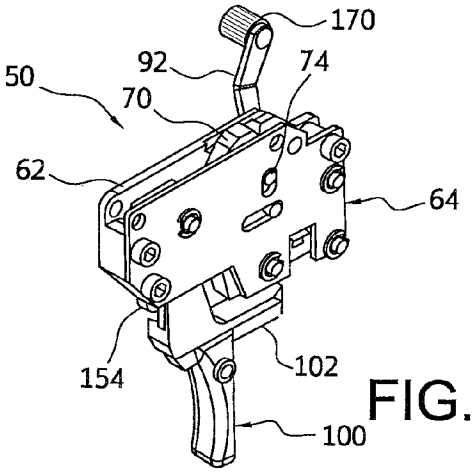
FIG. 4 is a top front perspective view of the left side of the trigger mechanism of FIG. 2.
Figure 5:
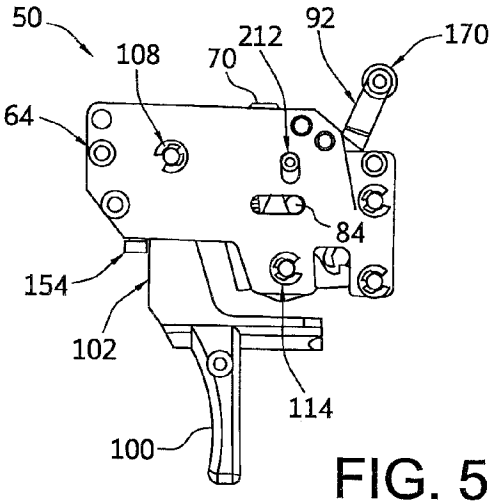
FIG. 5 is a left side plan view of the trigger mechanism of FIG. 4.

Turning now to a more detailed description of the present invention, FIG. 1A illustrates a prior art rifle 10 in which the "drop-in" trigger mechanism of the present invention may be utilized the place of a prior art trigger assembly 20 for use in actuating a firing pin or striker mechanism as is found in a typical bolt assembly 30 of the type found in a standard rifle such as a Remington 700® brand bolt action rifle. FIG. 1B is a diagram which illustrates how the prior art trigger 20 engages the firing pin cocking piece 32 of bolt assembly 30, when cocked and under spring pressure from the firing pin spring (not shown). FIG. 1B illustrates that when cocked, the bolt's firing pin cocking piece has a firing pin engagement surface 34, which is forced by the firing pin spring (not shown) into engagement with the prior art trigger sear at the trigger sear's bolt engagement surface, and the trigger sear prevents the cocking piece from forward travel until the trigger is pulled so that the bolt's firing pin engagement surface slides past the trigger sear's engagement surface under the power of the firing pin spring's force.

Figure 2:
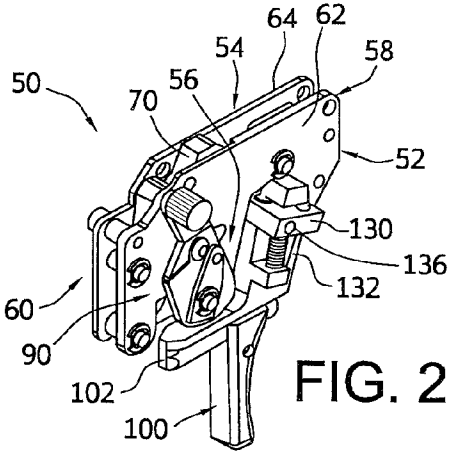
FIG. 2 is a top rear perspective view of the right side of a trigger mechanism in accordance with a first embodiment of the present invention.
Figure 3:
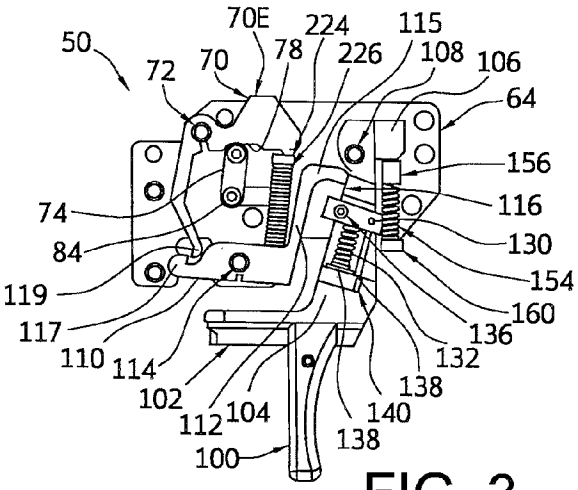
FIG. 3 is a right side plan view of the mechanism of FIG. 2, with the right side housing plate and thumb safety linkage removed.

The drop-in adjustable trigger assembly of the present invention is generally illustrated at 50 in FIGS. 2-6 and 17-19, to which reference is now made. It should be noted that the exploded view of the mechanism 50 in FIG. 6 includes a number of conventional screws, E clips, washers, and the like that are used to secure the walls of the assembly together to form the trigger housing, but these are not described in detail for simplicity. As illustrated, the drop-in trigger assembly 50 has a housing 52 enclosing the assembly and having an upper portion 54, a lower portion 56, a forward portion 58, and a rearward portion 60, with the housing being formed by a first, or right-side wall plate 62 and a second or left-side wall plate 64. As best seen in FIG. 3, wherein plate 62 is removed, and in FIG. 6, the housing 52 carries a pivoting bolt sear member 70 mounted on a bolt sear pin 72 extending between plates 62 and 64. A pivoting sear safety linkage 74 is mounted between plates 62 and 64 and has an upper camming surface 76 (FIG. 6) which engages a lower surface 78 of the pivoting bolt sear member 70. The housing has opposed sear safety linkage slots 80 and 82 in plates 62 and 64, respectively, which receive a lower pin 84 of linkage 74 to guide the pivoting sear safety linkage 74 in response to actuation of an upwardly projecting thumb safety linkage 90 actuated by a thumb safety lever 92.

As illustrated, the trigger assembly 50 includes a removable trigger shoe 100 beneath the housing which engages the bottom leg of a generally L-shaped trigger bar or bracket 102 which has an upwardly extending leg portion 104 pivotally mounted to a short pivot pin 108 which extends between and is supported by the housing plates 62 and 64 so that the trigger bracket 102 is configured to pivot within the housing 52 about the transverse axis of pivot pin 108 when trigger shoe 100 is pressed or squeezed by the shooter. An L-shaped trigger sear 110 having an upwardly and forwardly extending neck portion 112 is pivotally mounted on a safety pin 114 which extends through corresponding opposed apertures in housing plates 62 and 64 and is secured by suitable E-clips. The forwardmost end 115 of the trigger sear 110 is angled, or v-shaped, and engages an oval point set screw 116 threaded into an aperture 116' on the rear surface of the upper end 104 of the trigger bracket 102. The rearwardmost end 117 of the L-shaped trigger sear 110 incorporates a latching trough or edge 118 which receives and engages the lowermost end 119 of the pivoting bolt sear member 70.

The upper portion 104 of the trigger bracket 102 carries on its right-hand surface a first rocker screw support 120 spaced from a second, lower rocker screw support 122 and the trigger bracket's spaced rocker screw supports 120 and 122 extend laterally through an opening in the housing plate 62 when the housing is assembled. The pair of spaced rocker screw supports 120 and 122 receive an adjustable transverse rocker 130 positioned according to the user's desire at a selected distance from the upper rocker support 120 by a rocker screw 132 which passes through a threaded internal bore 134 in rocker 130 and is secured by a set screw 136, with a disc spring 138 at the bottom of the screw securing the screw in the bracket and urging the screw upwardly. An L-shaped rocker spring 140 engages the rocker at its upper end. The rocker preferably has a first stage movement adjustment and a second stage length adjustment. The rocker screw 132 and set screw 136 are adjustable to raise or lower the rocker to provide first stage trigger movement adjustment; the lower the rocker 130 is positioned, the smaller the trigger's 1st stage take-up, because of the angled forward face 112 on the pivoting trigger sear 110. Furthermore, as the transverse rocker 130 moves down, the mechanical advantage of the trigger mechanism is decreased, thus increasing the $2^{nd}$ stage weight required to fire, or increasing the force needed to cause the trigger to actuate or "break" (also known as the "weight of pull").

The trigger bar or bracket 102 has a forward end which provides a trigger bracket distally projection member 106 (FIGS. 3 and 6), and at the limit of the actuated movement of trigger bar or bracket 102, trigger bracket distally projection member 106 bears upon or rests on a plunger 156 and an adjustable spring 154 captured in an upper shoulder portion 150 of a support element 152 which is a part of, or is secured to, the wall plate 62 and spans the distance between right plate 62 and the opposing left wall plate 64. A spring 154 and a pin 156 extend through an aperture 158 of support element 152 and are adjustably secured therein by screw 160, with the top of the pin abutting the lower surface of trigger stop 106, to bias the trigger bar or bracket 102 in the unfired or rest position.

Figure 6:
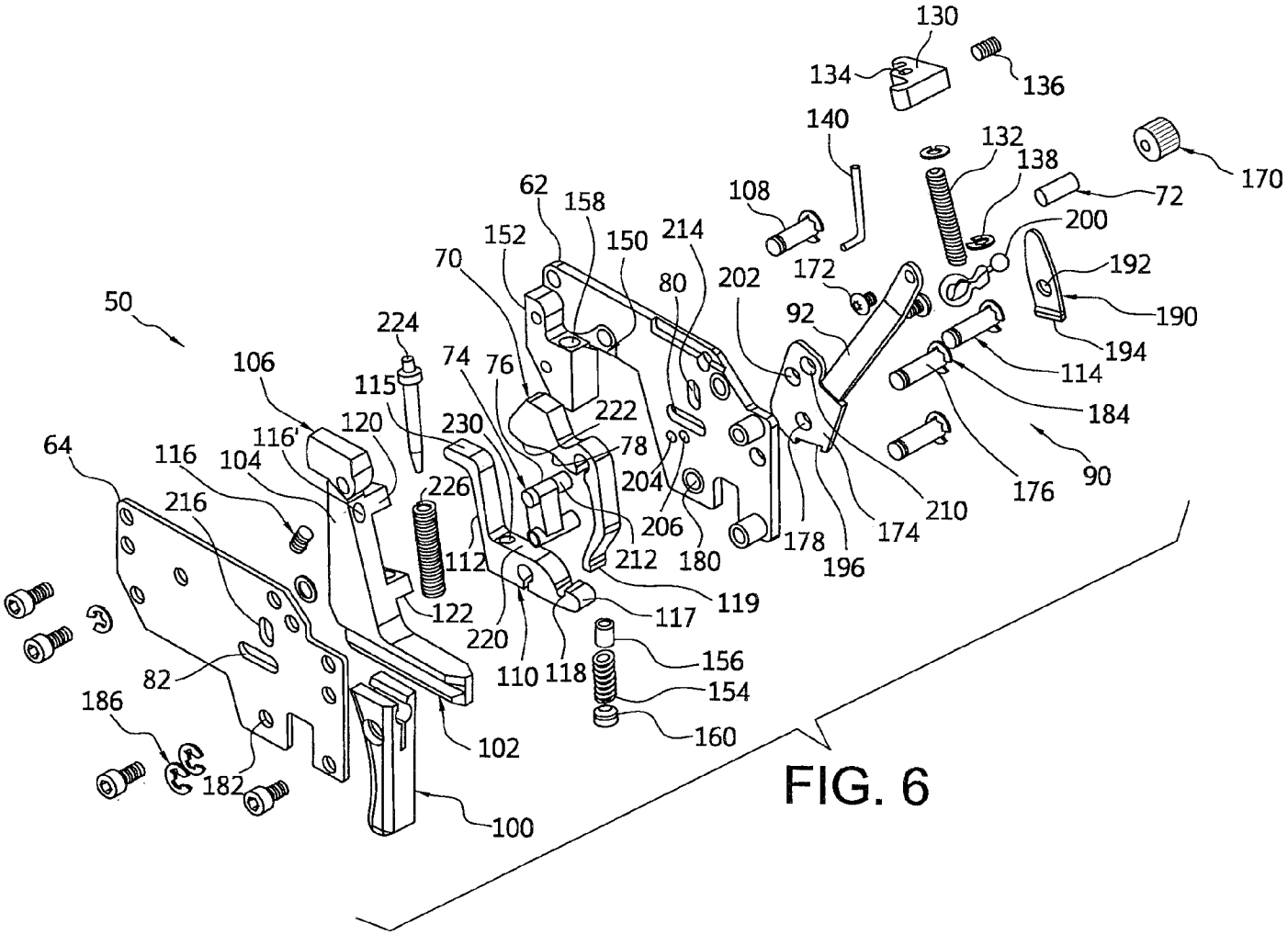
FIG. 6 is an exploded top rear perspective view of the trigger mechanism of FIG. 5.
Figure 17:
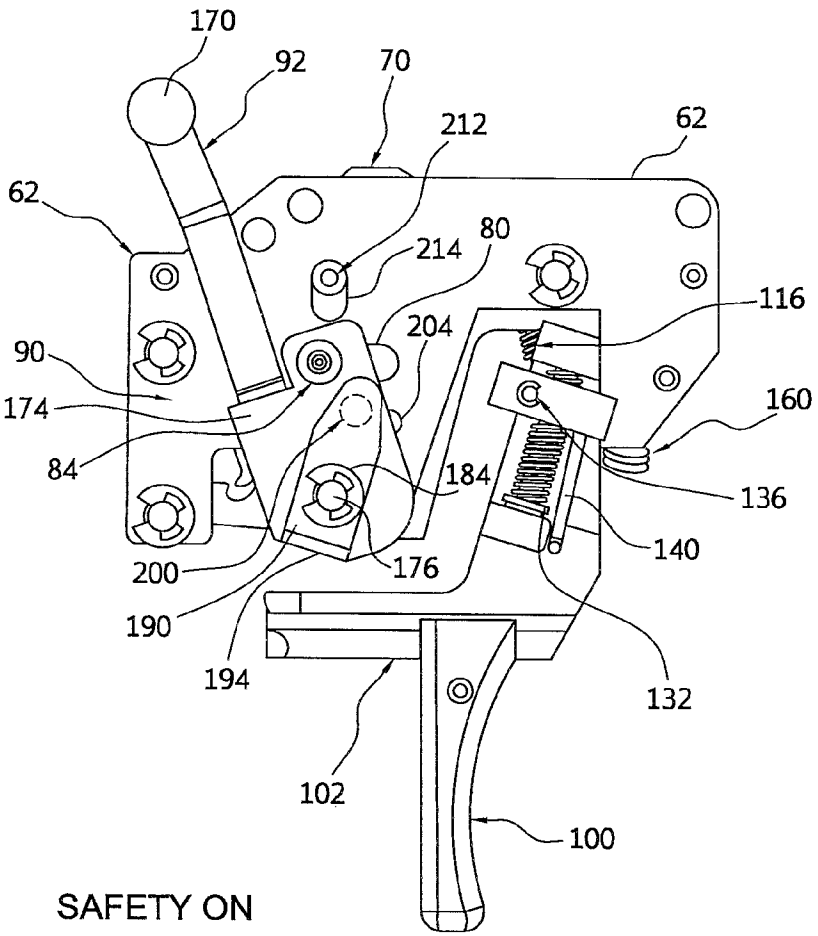
FIG. 17 is a right side plan view of the trigger mechanism of FIG. 2, illustrating its thumb safety linkage in a "safety on" position.

The pivoting safety mechanism 90, as best seen in FIGS. 2, 6 and 17, includes a thumb safety linkage or lever 92 incorporating at its upper or distal end a knurled cylinder 170 secured by a screw 172 and at its lower or proximal end a connector plate 174 which pivotally mounts the lever 92 to the housing plate 62 by way of a safety lever pivot pin 176. Safety pivot pin 176 passes through aperture 178 in connector plate 174 and apertures 180 and 182 in housing plates 62 and 64, respectively, and is secured at opposite ends by E clips and 184 and 186. A ball-detent safety tab 190 is mounted on pin 176 and is secured against the outer surface of the connector plate 174, with a bottom flange 194 of the tab engaging a bottom edge 196 of the plate 174 so that the tab 190 rotates with the plate 174. The tab provides a spring bias which bears against and secures a ball bearing 200 in an aperture 202 in safety connector plate 174, the ball bearing extending through the aperture to serve as a detent that engages one or the other of spaced apart side plate apertures 204 or 206 to provide a positive "feel" as the safety mechanism 90 pivots between "on" or "off" positions.

The connector plate 174 also incorporates a safety linkage aperture 210 which is aligned with slot 80 in housing plate 62 and receives the lower pin 84 of pivoting sear safety linkage 74, so that pivoting the thumb safety linkage lever 92 between on and off positions causes pin 84 to move back and forth in side plate slot 80 (and in its opposing slot 82 in housing plate 64). This motion causes the upper pin 212 of pivoting sear safety linkage 74 to move vertically in its corresponding vertical side plate slots 214 and 216 in housing plates 62 and 64, respectively.

Mounted between an upper surface 220 of the L-shaped trigger sear 110 and a downwardly facing surface 222 of pivoting bolt sear member 70 is a spring-biased reset pin 224 surrounded by a spring 226. The lower end of reset pin 224 is tapered and received in a depression 230 in upper surface 220 of the L-shaped trigger sear 110. The reset pin spring 226 causes the L-shaped trigger sear 110 to reset after the trigger mechanism has been operated to fire a shot.

Figure 7:
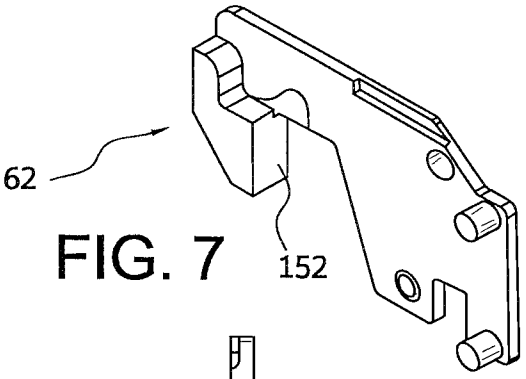
FIG. 7 is a perspective view the interior of a cast right side housing plate for the mechanism of FIG. 2, before machining.
Figure 8:
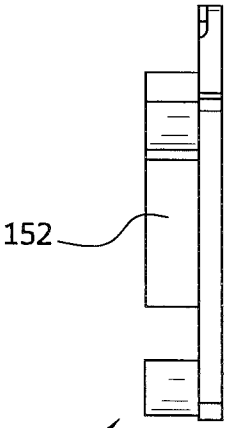
FIG. 8 is an end view of the plate of FIG. 7.
Figure 9:
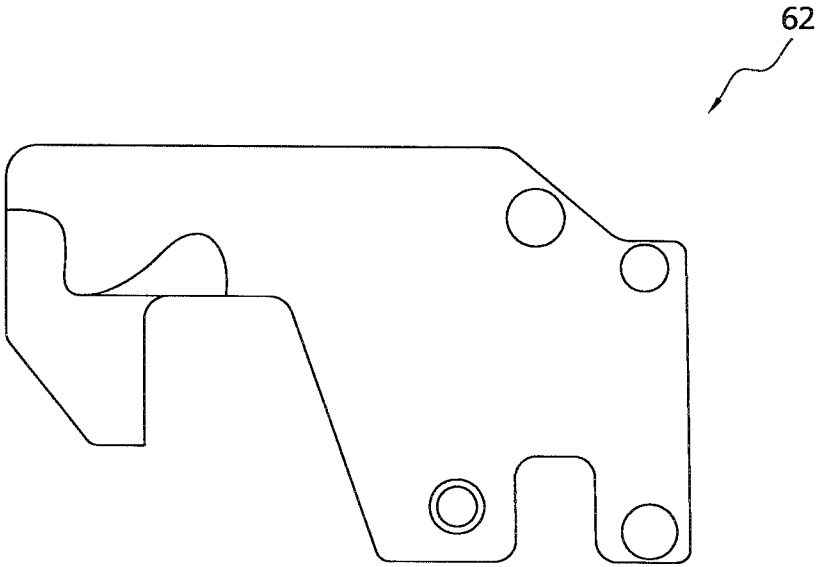
FIG. 9 is a plan view of the casting of FIG. 7, showing typical casting dimensions.
Figure 10:
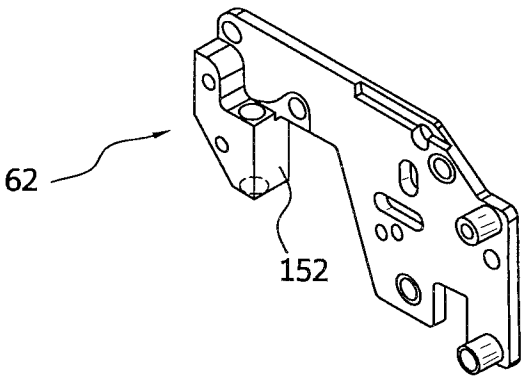
FIG. 10 is a perspective view of the housing plate of FIG. 7, after machining.
Figure 11:
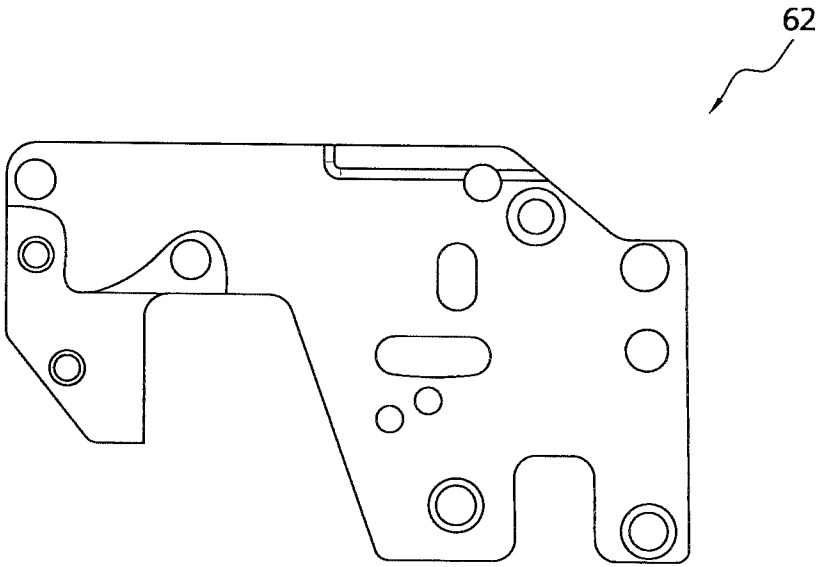
FIGS. 11 and 12 are plan views of the housing plate of FIG. 10, illustrating typical machining dimensions.
Figure 14:
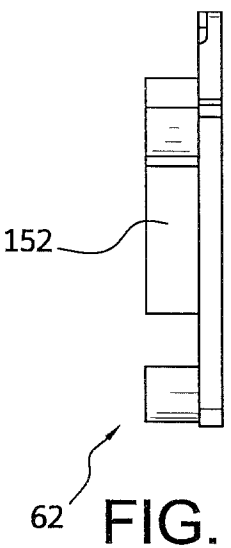
FIG. 14 is an end view of the element of FIG. 12.
Figure 12:
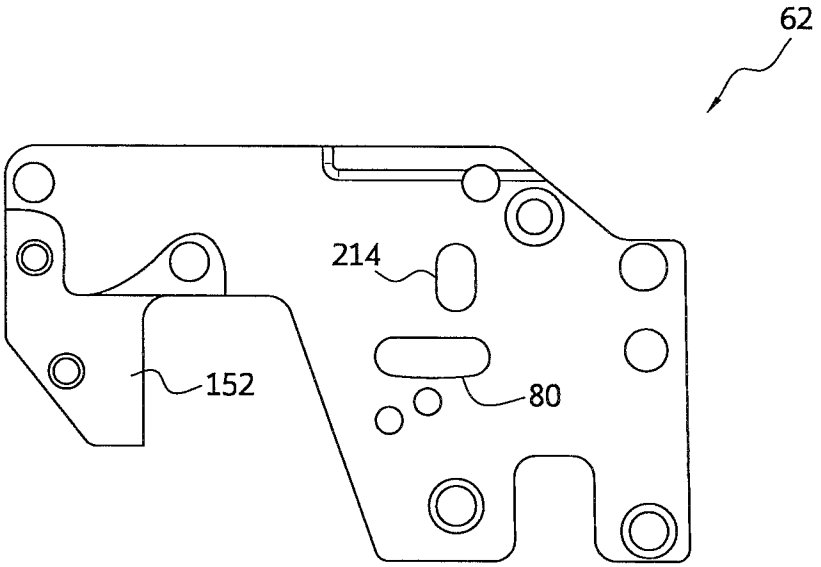
Figure 13:
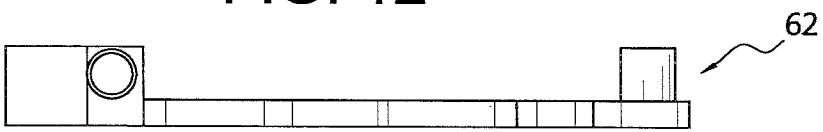
FIG. 13 is a top view of the element of FIG. 12.
Figure 15:
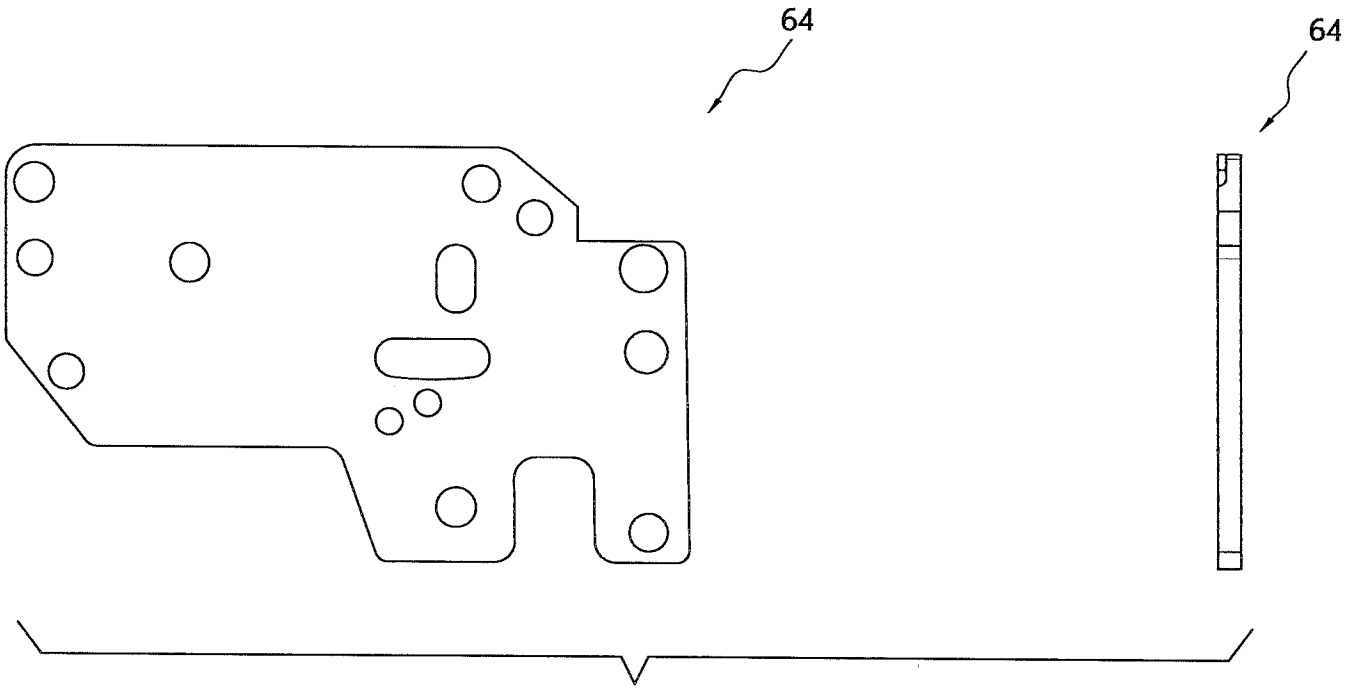
FIGS. 15 and 16 illustrate typical machining dimensions for the left side housing plate of the trigger mechanism of FIG. 2.
Figure 16:
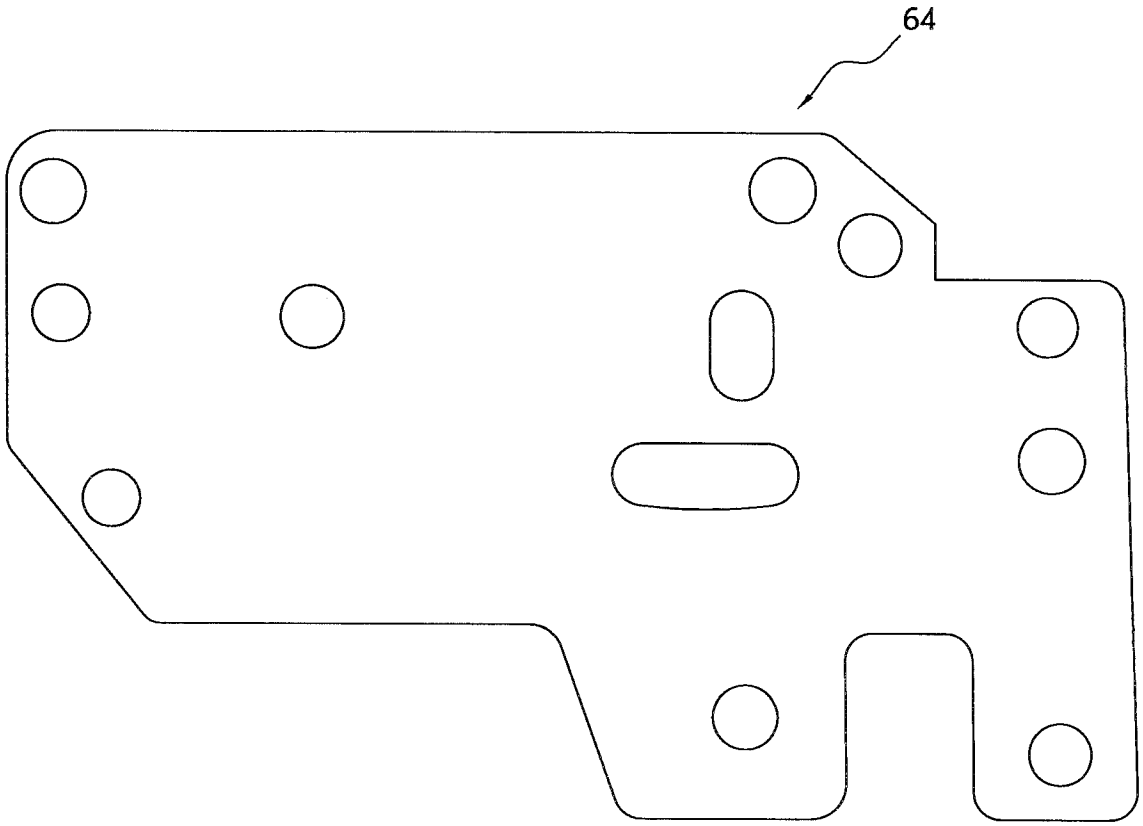

The components of trigger assembly 50 are preferably manufactured from steel, aluminum, or a similarly durable material, using wire EDM machining methods, laser cutting, CNC machining, forming presses or casting methods. As an example of these methods, steps for manufacturing one of these components, the right side housing plate 62, is illustrated in FIGS. 7-16, FIG. 7 is a perspective view the interior of a cast right side housing plate, before machining; FIG. 8 is an end view of the plate of FIG. 7; and FIG. 9 is a plan view of the casting of FIG. 7, showing typical casting dimensions. FIG. 10 is a perspective view of the housing plate of FIG. 7, after machining, while FIGS. 11 and 12 are plan views of the housing plate of FIG. 10, illustrating typical machining dimensions. FIG. 13 is a top view of the element of FIG. 12 and FIG. 14 is an end view of the element of FIG. 12. FIGS. 15 and 16 illustrate typical machining dimensions for the left side housing plate 64 of the trigger mechanism 50 of FIG. 2.

Figure 18:
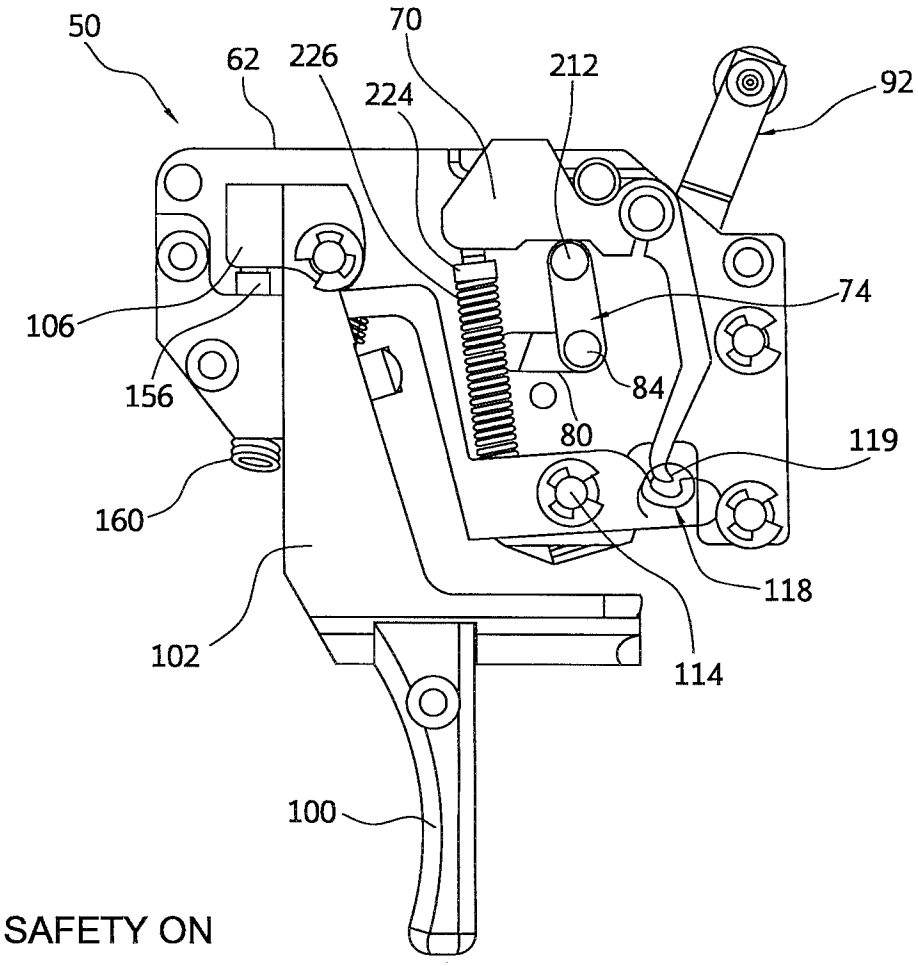
FIG. 18 is a left side plan view of the trigger mechanism of FIG. 2 with the left side housing plate removed to illustrate the positions of the trigger mechanism elements with its thumb safety linkage in the "safety on" position.
Figure 19:
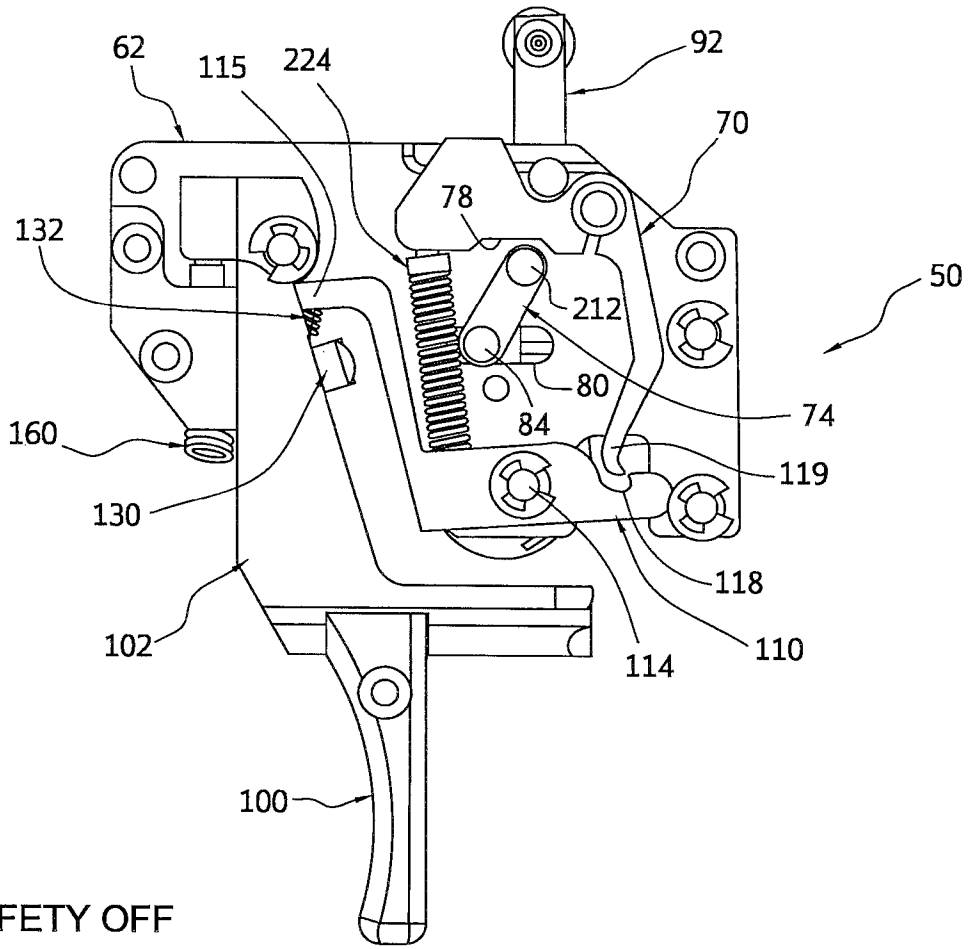
FIG. 19 illustrates the device of FIG. 18 in the "safety off" position.

The trigger mechanism 50 works by closing the bolt 30 on a rifle or similar firearm which transfers firing pin spring force from bolt assembly 30 through a cocking piece's firing pin engagement surface 34 which then bears upon to the upper engagement surface 70E at the top of pivoting bolt sear member 70, which projects from the top portion of housing 50, as illustrated in FIGS. 2-5 and in FIGS. 17-19. With the trigger assembly of the present invention 50 installed in a firearm such as rifle 10 it will not fire until the cocking piece 32 forces the bolt sear's upper engagement surface 70E down and pivots the bolt sear 70 in a clockwise direction, as viewed in FIG. 3, sufficiently far to cause the distal tip 119 of bolt sear 70 to engage the latch 118 on the engagement surface of trigger sear 110 (best seen in FIGS. 3 and 6). The pivoting motion terminates when the upper end 76 of the sear safety linkage 74 presses against and engages bolt sear 70 at bolt sear lower bearing surface 78, thus preventing the bolt sear from pivoting further under force from the bolt sear reset spring 226 and disengaging the bolt sear's distal tip 119 from the trigger sear's engagement surface 118. The bolt sear 70 is thus configured to work with and actuate cocking piece 32 in a rifle's bolt assembly (e.g., 30 such as used in rifle 10).

The drop-in trigger assembly of the present invention is compact and robust, due in part to the configuration of the housing's right side plate 62 and left side plate 64, which carry, orient and support the fixed and moving components of the assembly. Although not described, it will be evident from the exploded view of FIG. 6 that numerous screws and pins extend between the side plates to secure the movable parts within or on the housing. These components include the pivoting safety linkage 90 and its thumb safety lever 92 which is rotatable about the axis of transverse pivot pin 176 from a forward "safety off" position (see FIG. 19) to a rearward "safety on" position (see FIGS. 17 and 18). Pivoting sear safety linkage 74 is driven by sear safety linkage pin 84, which is transversely inserted in the safety lever connector plate aperture 210 which drives the lower end of the elongated pivoting sear safety linkage 74 forwardly or rearwardly in elongated housing slots 80 and 82 to cause the sear safety linkage's upper end 76 to be moved downwardly or upwardly, respectively, in slots 214 and 216 in response to safety linkage movement.

As described above, the internal threaded bore 134 of the pivoting transverse rocker 130 engages rocker screw 132 to raise or lower the rocker, and the lower the rocker is positioned, the smaller the trigger's 1st stage take-up distance, because rocker 130 then bears against the angled forward face 112 on the pivoting trigger sear 110. The housing also carries the transverse trigger sear pivot pin or safety pin 114 which defines the pivot axis for the L-shaped trigger sear 110 and trigger sear 110 has its forward face 112 on the forward side of the pivot. Trigger sear 110 has its trigger sear engagement surface 118 on the rearward side of the pivot pin 114 (FIG. 3).

As best seen in FIGS. 17-19, when the shooter moves the pivoting safety lever 92 from the rearward "safety on" position (FIGS. 17 and 18) to the forward "safety off" position (FIG. 19), the pivoting safety link's sear safety linkage pin 84 is shifted to its forward position in slots 80 and 82, and the pivoting safety link's upper pin 212 is pulled down in its corresponding slots 214 and 216. This disengages pivoting safety link 74 from the bolt sear's lower bearing surface 78, thus allowing the bolt sear 70 to pivot counter-clockwise, as viewed in FIG. 19, under force from the bolt assembly's firing pin spring, when the rifle is fired. Bolt sear reset spring 226 will "reset" the bolt sear's distal tip 119 into engagement with the trigger sear's engagement surface 118 when the rifle's bolt is cycled.

When the shooter moves the pivoting safety lever from the forward "safety off" position of FIG. 19 to the rearward "safety on" position of FIGS. 17 and 18, the safety linkage pin 84 drives the lower end of pivoting safety link 74 rearwardly in the housing slots 80 and 82 so that the sear safety linkage's upper pin 212 pivots upwardly in slots 214 and 216, pressing pivoting safety link's upper surface 76 against and engaging the lower bearing surface 78 of the bolt sear 70. This prevents the bolt sear from pivoting under force from the cocked bolt assembly's firing pin spring (not shown) and disengages the bolt sear's distal tip 119 from the engagement surface 118 of the trigger sear 110.

As noted above, trigger assembly 50 incorporates user adjustable controls for a first stage weight of pull, first stage travel or movement range, second stage break weight and second stage engagement length, each of which can be optimized separately for accurate shooting. In the illustrated embodiment of FIGS. 2-19, the trigger mechanism uses two springs, where first stage weight is adjusted by compressing spring 154 with adjustment screw 160, which preferably has a spring constant of approximately 15.8 lbs per inch. Trigger reset spring 226 serves to reset the connection between the bolt sear and the trigger sear for firing the next shot and reset spring 226 is constrained and guided by reset pin 224 which engages bolt sear 70 on the pin's (upper) while end trigger sear 110 bears on reset spring 226 at the spring's lower end. Reset spring 226 preferably has a spring constant of approximately 29 lbs per inch.

It will be appreciated by persons of skill in the art that the trigger assembly 50, when installed in a rifle (e.g., 10), is actuated when trigger shoe 100 is pressed, which pivots trigger bracket 102 rearward about pivot pin 108 (clockwise in FIG. 3), causing the trigger bar or bracket 102 to force rocker 130 rearwardly toward the forward surface 112 of trigger sear 110. In response, trigger sear 110 pivots slightly (counterclockwise in FIG. 3), reducing the $2^{nd}$ stage engagement overlap between edges 118 and 119 to just a few thousandths of an inch (e.g., 0.002-0.005 in). At some point during this rearward travel, trigger bracket 102 stops pivoting rearwardly because rocker 130 has engaged the trigger sear 110, thus ending the length of the $1^{st}$ stage of trigger pull. As the shooter or marksman continues to increase trigger pressure on trigger shoe 100, the rocker 130 begins rotating the trigger sear 110, until the last few thousandths of an inch of overlapping engagement length of its latching edge 118 is free of engagement with surface 119 of the bolt sear 70, thus breaking contact and enabling trigger actuation in that instant. In response to this release, the bolt sear 70 pivots forward and down (clockwise in FIG. 3), releasing cocking piece 32 in bolt assembly 30 to drive the firing pin (not shown) into the cartridge, firing the rifle. The first stage weight for trigger assembly 50 is adjustable by the control or set screw 116 independently of the first stage length of travel, which is controlled by the rocker vertical position adjustment screw 132. The second stage weight is adjusted, in part, by the rocker adjustment screw 132 on the trigger bracket's side which moves rocker 130 up and down, changing its mechanical advantage. The second stage length of engagement is adjusted by the control screw or adjustment set screw 116 which is threaded into a bore 116' inside the upper end 104 of the trigger bracket 102 that defines the distal surface to push on the very upper end of the front surface 115 of trigger sear 110, pivoting it away from the bolt sear to set the "crisp" break (or actuation sensation) of trigger assembly 50. The second stage weight is also adjusted by the spring 154 and its adjustment screw 160, which oppose the rotation of the trigger bracket 102. Trigger assembly 50 thus has adjustable first stage length of pull, first stage weight, second stage length of pull and second stage weight. The total weight is the sum of first stage weight and second stage weight and is adjustable from 8 ounces to three and one half pounds. Using these adjustments, the trigger first stage weight and second stage weight can be adjusted by the user for to achieve, for example, a total weight of 30 ounces where either the first stage weight is 5 ounces (meaning the second stage weight is a relatively heavy 25 ounces) or where the first stage weight is 25 ounces (meaning the second stage weight is a relatively light 5 ounces).

The safety mechanism consists of thumb safety linkage 90 which cams pivoting safety link 74 past top dead center, pushing upward on the bolt sear 70 and locking it in place, while simultaneously disengaging from the trigger sear 110. The ball detent mechanism (190, 200 and apertures 204 and 206) captures the safety linkage 90 and keeps it in place, providing an audible and tactile "click" sensation of positive control for the shooter. The pivoting safety link or sear safety linkage 74 and thumb safety linkage 90 comprise a "two-bar linkage" which cooperate to provide large mechanical advantage but require small safety actuating force from the user, and an "overcamming" action provided by the travel of sear safety linkage 74 in the slots of housing plates 62 and 64 serves as a failsafe adapted to prevent accidental release of the bolt assembly's firing pin and discharge. When the safety is on (FIG. 18) the sear safety linkage 74 engages the bottom surface 78 of bolt sear 102, pivoting it up (clockwise in FIG. 6) to disengage it from the trigger sear 110 and preventing it from rotating to fire the firearm. The illustrated trigger assembly 50 is adaptable for use with a left hand side safety lever which projects downwardly into the area proximate the trigger shoe.

Figure 22:
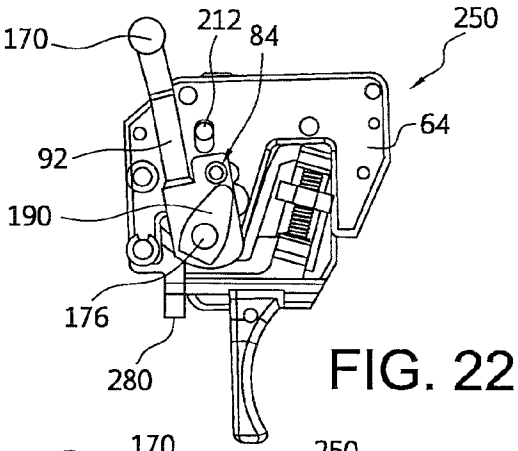
FIG. 22 is a right side plan view of the second embodiment of the trigger mechanism of the present invention.
Figure 20:
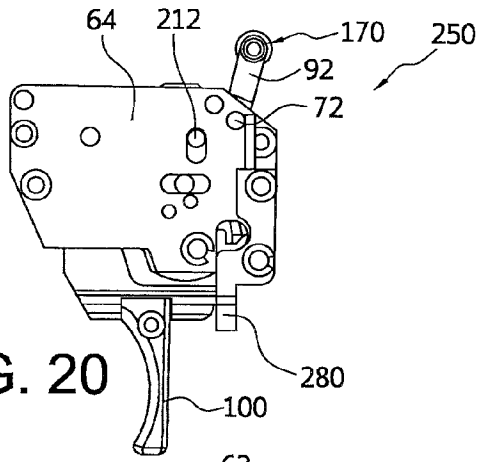
FIG. 20 is a left side plan view of a second embodiment of the trigger mechanism of the present invention.
Figure 23:
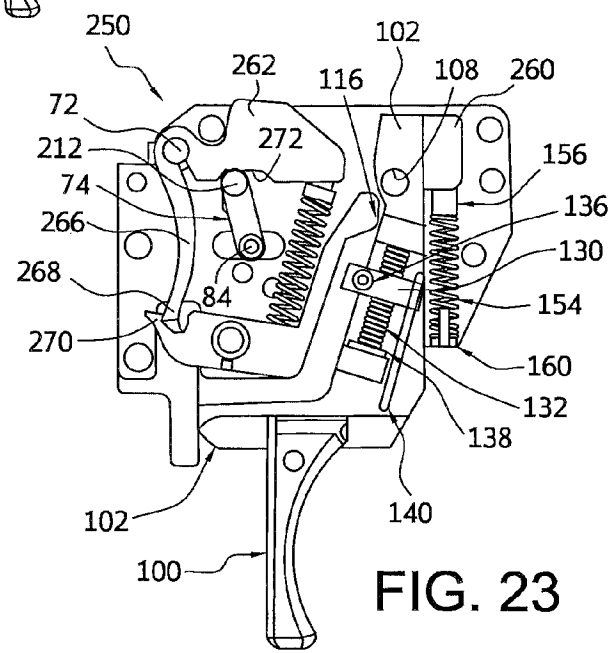
FIG. 23 is a right side plan view of the second embodiment of the trigger mechanism of the present invention, with the right side housing plate and the thumb safety lever removed.
Figure 21:
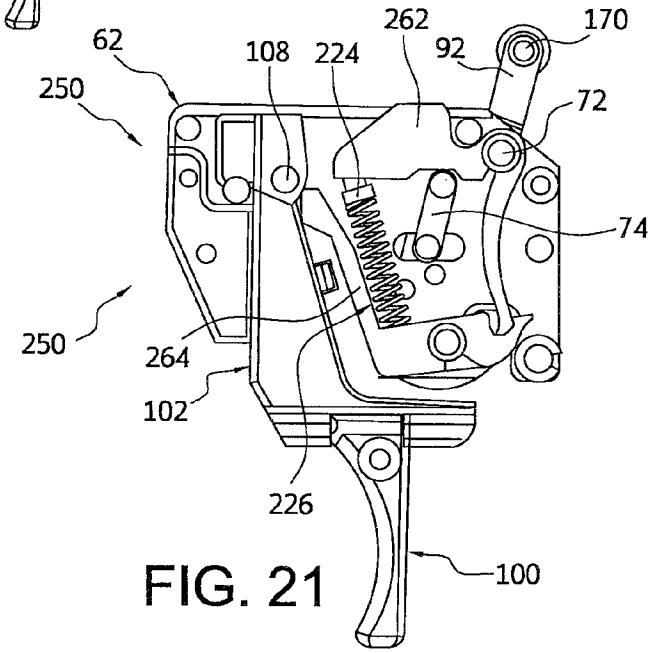
FIG. 21 is a left side plan view of the second embodiment of the trigger mechanism of the present invention, with the left side housing plate removed.
Figure 24:
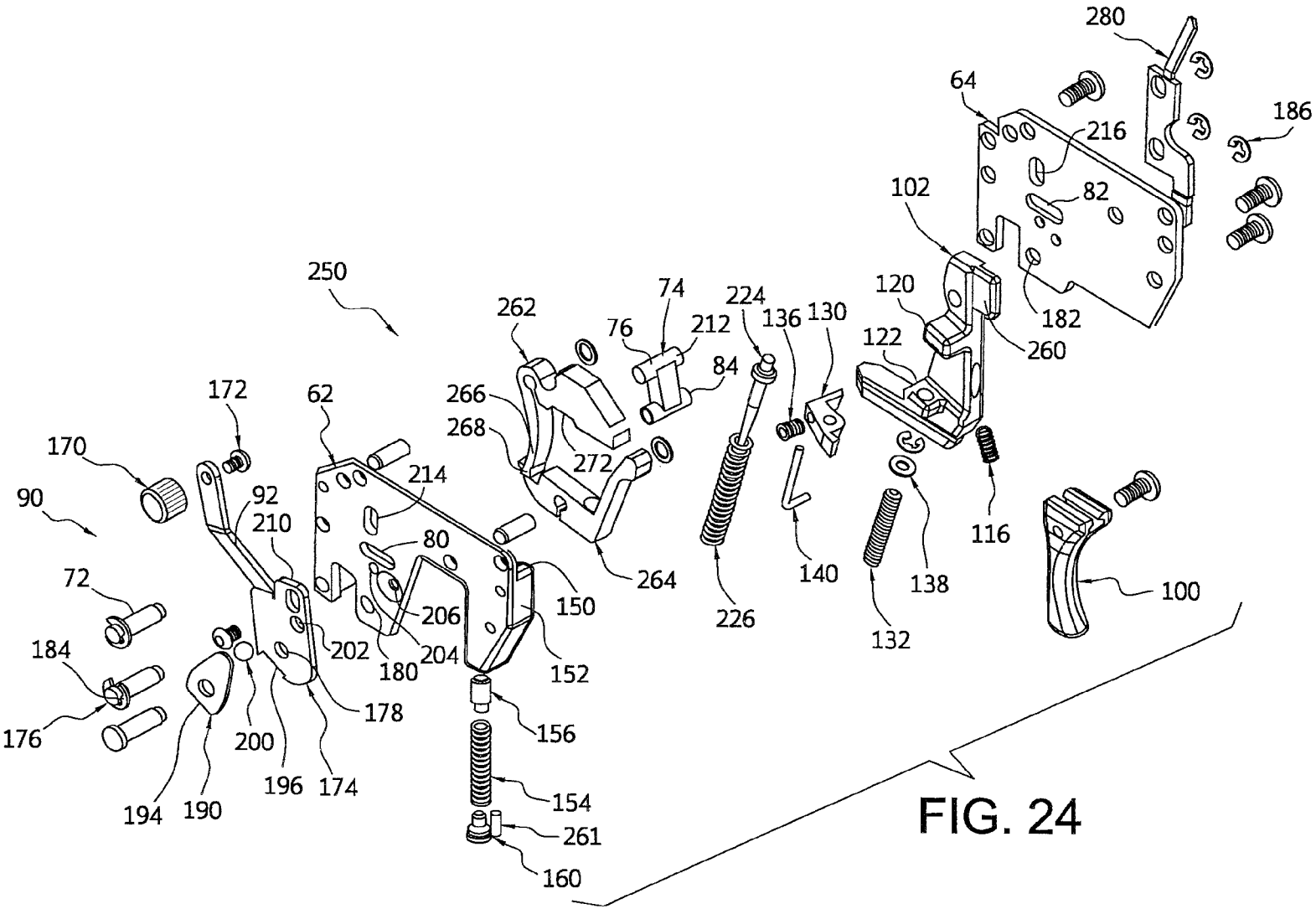
FIG. 24 is an exploded top front perspective view of the mechanism of FIG. 22.

A second embodiment of the trigger assembly of present invention is illustrated at 250 in FIGS. 20-28, wherein components in common with the first embodiment are similarly numbered. It is noted that the exploded view of this embodiment illustrated in FIG. 24 is a top-front perspective view instead of the rear perspective of the first embodiment of FIG. 6. The replacement trigger assembly 250 includes right and left side housing plates 62 and 64 supporting a thumb safety linkage 90 on right side-plate 62. A reversible (front to back) trigger shoe 100 is releasably secured to a trigger bracket 102 which is pivotably mounted between the housing's side plates 62, 64. As in the previous embodiment, the trigger bar or bracket 102 includes a laterally projecting pair of spaced rocker screw supports 120 and 122 between which is mounted a rocker 130 on an adjustment screw 132 held in place by an E clip and spring washer 138, with rocker 130 being carried and held in position after adjustment by a set screw 136 and biased by a spring 140. In this embodiment, the upper portion of trigger bracket 102 is shaped slightly differently, but, as before trigger bracket distally projection member 260 bears upon or rests on a plunger 156 and an adjustable spring 154 captured in an upper shoulder portion 150 of a support element 152 which is a part of, or is secured to, the wall plate 62 and spans the distance between right plate 62 and the opposing left wall plate 64 (FIG. 23). Adjustment spring 154 and a plunger or pin 156 extend through an aperture 158 within support element 152 and are adjustably secured therein by adjustment screw 160, with the top of the pin abutting and bearing against the lower surface of trigger bar member 260. The lower end of adjustment spring 154 is centered on the screw 160 by a centering pin 261.

Also mounted within the sidewalls 62 and 64 are a pivotally mounted bolt sear 262 and a pivotally mounted trigger sear 264, slightly different in shape, but similar in function to the bolt sear 70 and the trigger sear 110 of the first embodiment. Reset pin 224 and reset spring 226 are mounted between bolt sear 262 and trigger sear 264 to reset the trigger sear, as previously described. As in the previously-described embodiment, the lower end 266 of bolt sear 262 incorporates a downwardly facing latching edge 268 which engages a corresponding upwardly facing edge 270 on trigger sear 264. The trigger mechanism 250 also incorporates a side safety bolt release lever 280 pivotally mounted on the housing's left side-plate 64.

A pivoting safety link or sear safety linkage 74 is mounted between plates 62 and 64 and has an upper camming surface 76 which engages a lower surface 272 of bolt sear 262. The housing has opposed horizontal sear safety linkage slots 80 and 82 in plates 62 and 64, respectively, which receive a lower pin 84 of pivoting safety link 74 to guide the pivoting safety link's movement in response to actuation of the upwardly projecting thumb safety 90 actuated by the safety lever 92.

The pivoting safety mechanism 90 for this embodiment works in the same manner as the safety mechanism of first embodiment, and, as best seen in FIGS. 22 and 24, includes a lever 92 incorporating at its upper end a thumb cylinder 170 secured by a screw 172 and at its lower end a connector plate 174 which pivotally mounts the lever 92 to the housing plate 62 by way of a pin 176. This pin passes through aperture 178 in connector plate 174 and apertures 180 and 182 in housing plates 62 and 64, respectively, and is secured at opposite ends by E clips and 184 and 186. A ball safety tab 190 is mounted on pin 176 and is secured against the outer surface of the connector plate 174 by clip 184. A bottom flange 194 engages a bottom edge 196 of the plate 174 so that the tab 190 rotates with the plate 174. The tab secures a ball bearing 200 in an aperture 202 in plate 174, the ball bearing extending through the aperture to serve as a detent that engages one or the other of apertures 204 or 206 to provide a positive "feel" as the safety mechanism pivots between "on" or "off" positions.

The connector plate 174 also incorporates a safety linkage aperture 210 which is aligned with slot 80 in housing plate 62 and receives the lower pin 84 of pivoting safety link 74, so that pivoting the thumb safety lever 92 between on and off positions causes pivoting safety link's pin 84 to move back and forth in slot 80 (and in its opposing slot 82 in housing plate 64). This motion causes the upper pin 212 of pivoting safety link 74 to move vertically in its corresponding slots 214 and 216 in housing plates 62 and 64, respectively.

Figure 26:
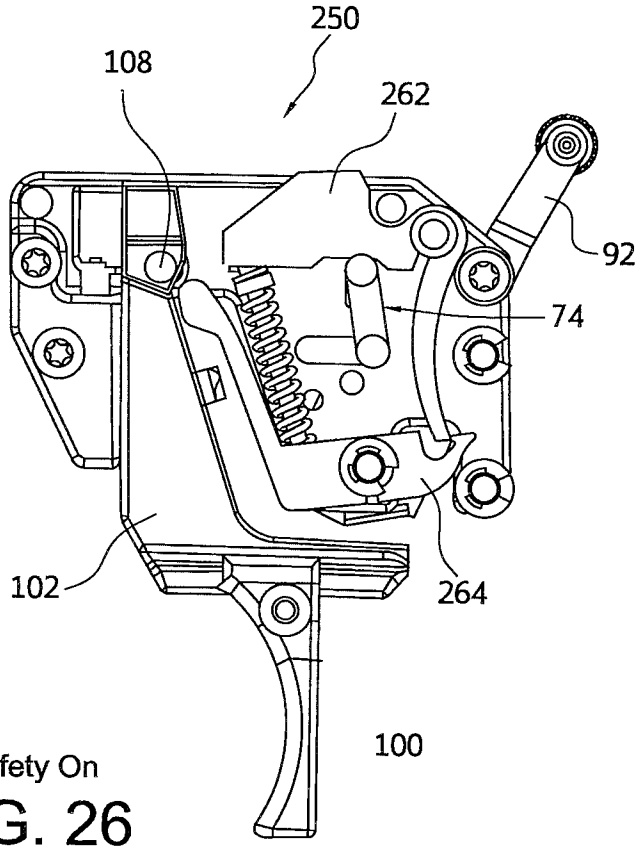
FIGS. 25 and 26 illustrate a "safety on" condition of the mechanism of FIG. 20.
Figure 25:
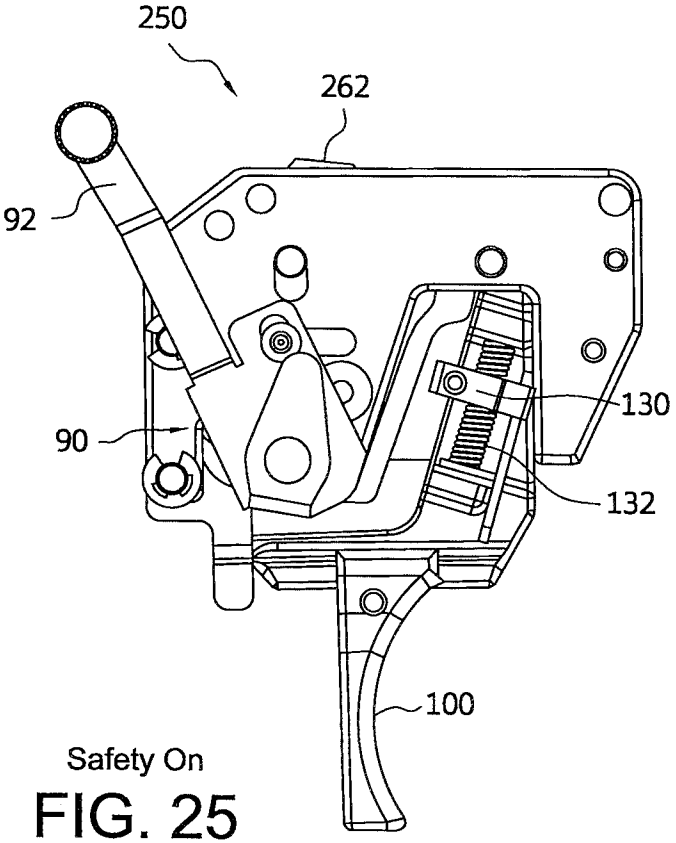
Figure 28:
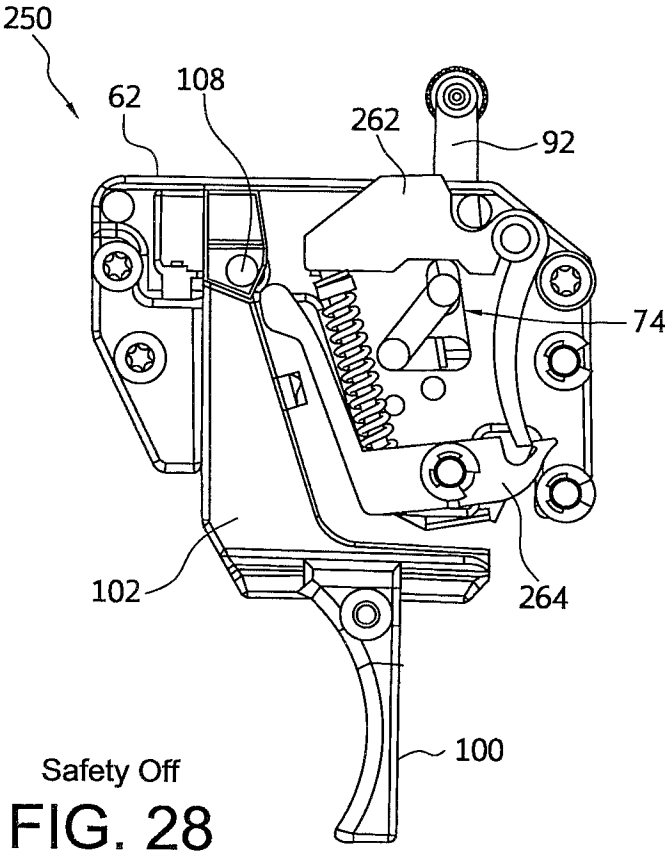
FIGS. 27 and 28 illustrate a "safety off" condition of the mechanism of FIG. 20.
Figure 27:
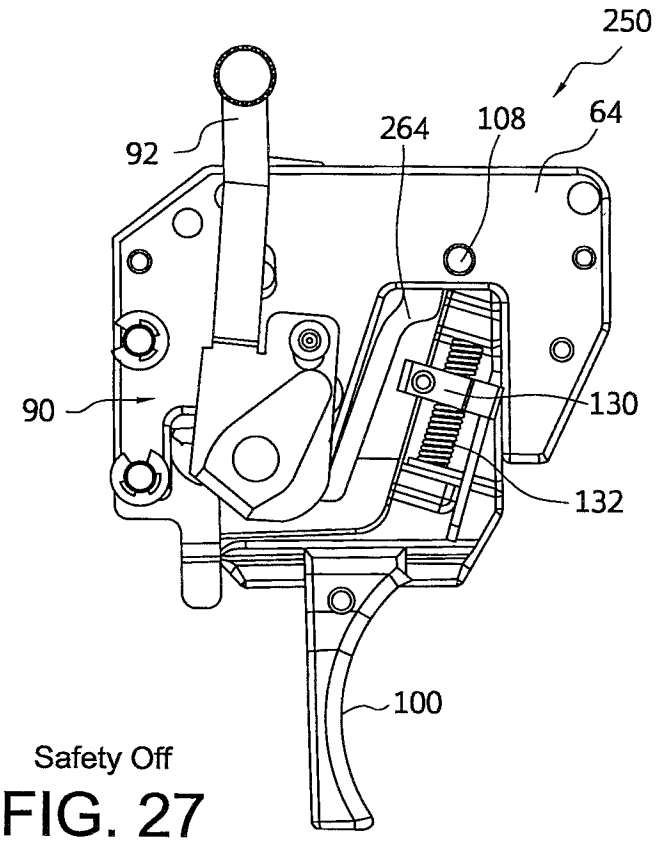

FIGS. 25 and 26 illustrate the "safety on" position of the safety mechanism 90, for the second embodiment of the invention, with FIG. 25 illustrating the exterior of the right-hand side of the trigger assembly 250 and FIG. 26 illustrating the trigger assembly from the left-hand side with the housing plate 64 removed to make the interior of the assembly visible. Similarly, the "safety off" position of the safety mechanism 90 is illustrated in FIGS. 27 and 28, which show the exterior and interior views, respectively of the assembly 250.

As with the first embodiment, trigger assembly 250 incorporates user adjustable controls for a first stage weight of pull, first stage travel or movement range, second stage break weight and second stage engagement length, each of which can be optimized separately for accurate shooting. As illustrated in FIGS. 20-28, trigger mechanism 250 uses two springs, where first stage weight is adjusted by compressing spring 154 with adjustment screw 160, which preferably has a spring constant of approximately 15.8 lbs per inch. Trigger reset spring 226 serves to reset the connection between the bolt sear and the trigger sear for firing the next shot and reset spring 226 is constrained and guided by reset pin 224 which engages bolt sear 262 on the pin's (upper) while end trigger sear 264 bears on reset spring 226 at the spring's lower end. Reset spring 226 preferably has a spring constant of approximately 29 lbs per inch.

It will be appreciated by persons of skill in the art that the trigger assembly 250, when installed in a rifle (e.g., 10), is actuated when trigger shoe 100 is pressed, which pivots trigger bracket 102 rearward about pivot pin 108 (clockwise in FIG. 23), causing the trigger bar or bracket 102 to force rocker 130 rearwardly toward the forward surface of trigger sear 264. In response, trigger sear 264 pivots slightly (counter-clockwise in FIG. 23), reducing the $2^{nd}$ stage engagement overlap between edges 268 and 270 to just a few thousandths of an inch (e.g., 0.002-0.005 in). At some point during this rearward travel, trigger bracket 102 stops pivoting rearwardly because rocker 130 has engaged the trigger sear 264, thus ending the length of the $1^{st}$ stage of trigger pull. As the shooter or marksman continues to increase trigger pressure on trigger shoe 100, the rocker 130 begins rotating trigger sear 264, until the last few thousandths of an inch of overlapping engagement length of its latching edge 270 is free of engagement with surface 268 of the bolt sear 70, thus breaking contact and enabling trigger actuation in that instant. In response to this release, the bolt sear 262 pivots forward and down (clockwise in FIG. 3), releasing cocking piece 32 in bolt assembly 30 to drive the firing pin (not shown) into the cartridge, firing the rifle. The first stage weight for trigger assembly 250 is adjustable by the control or set screw 116 independently of the first stage length of travel, which is controlled by the rocker vertical position adjustment screw 132. The second stage weight is, in part, adjusted by the rocker adjustment screw 132 on the trigger bracket's side which moves rocker 130 up and down, changing its mechanical advantage. The second stage length of engagement is adjusted by the control screw or adjustment set screw 116 which is threaded into a bore 116' inside the upper end 104 of the trigger bracket 102 that defines the distal surface to push on the very upper end of the front surface 115 of trigger sear 110, pivoting it away from the bolt sear to set the "crisp" break (or actuation sensation) of trigger assembly 50. The second stage weight is also adjusted by the spring 154 and its adjustment screw 160, which oppose the rotation of the trigger bracket 102. Trigger assembly 250 thus has adjustable first stage length of pull, first stage weight, second stage length of pull and second stage weight. The total weight is the sum of first stage weight and second stage weight and is adjustable from 8 ounces to three and one half pounds. Using these adjustments, the trigger first stage weight and second stage weight can be adjusted by the user for to achieve, for example, a total weight of 30 ounces where either the first stage weight is 5 ounces (meaning the second stage weight is a relatively heavy 25 ounces) or where the first stage weight is 25 ounces (meaning the second stage weight is a relatively light 5 ounces).

The safety mechanism consists of thumb safety linkage 90 which cams pivoting safety link 74 past top dead center, pushing upward on the bolt sear 262 and locking it in place, while simultaneously disengaging from trigger sear 264. The ball detent mechanism (190, 200 and apertures 204 and 206) captures the safety linkage 90 and keeps it in place, providing an audible and tactile "click" sensation of positive control for the shooter. The pivoting safety link or sear safety linkage 74 and thumb safety linkage 90 comprise a "two-bar linkage" which cooperate to provide large mechanical advantage but require small safety actuating force from the user, and an "overcamming" action provided by the travel of sear safety linkage 74 in the slots of housing plates 62 and 64 serves as a failsafe adapted to prevent accidental release of the bolt assembly's firing pin and discharge. When the safety is on (FIGS. 25, 26) the sear safety linkage 74 engages the bottom surface of bolt sear 262, pivoting it up (clockwise in FIG. 26) to disengage it from trigger sear 264 and preventing it from rotating to fire the firearm. The illustrated trigger assembly 250 is adaptable for use with a left hand side safety lever which projects downwardly into the area proximate the trigger shoe.

The trigger assembly of the present invention (e.g., 50 or 250) provide a surprising range of tunable or adjustable features in a mechanism which will, even when adjusted for very light trigger weights, still provide safeguards against unintentional discharge due to the rifle being dropped or negligent handling, so long as camming safety mechanism 90 is "ON". Safety mechanism 90 blocks the bolt sear's movement, keeping it rigidly locked against the rifle's firing pin engagement surface 34 while simultaneously disconnecting the trigger sear from the bolt sear.

Having described preferred embodiments of a new and improved trigger assembly structure and method, it is believed that other modifications, variations and changes will be suggested to those skilled in the art in view of the teachings set forth herein. It is therefore to be understood that all such variations, modifications and changes are believed to fall within the true spirit and scope of the present invention as defined by the following claims.

What is claimed is:

1. A drop-in adjustable trigger assembly, having a housing incorporating first and second spaced wall plates;

a trigger bracket pivotally mounted between said wall plates and configured to pivot within the housing about a pivot point positioned within the housing;

a removable trigger shoe carried by said trigger bracket;

an adjustable rocker mounted on said trigger bracket;

a bolt sear pivotally mounted between said wall plates and having a first latching end and a spaced second end;

a trigger sear pivotally mounted between said wall plates and having a first end engaging said rocker on said rocker and a second end engagable with said bolt sear latching end;

a reset spring extending between and engaging said bolt sear and said trigger sear;

a safety mechanism actuable by a thumb safety lever mounted on said housing and incorporating a pivotable sear safety linkage mounted between said housing wall plates and movable in corresponding safety linkage slots defined in the wall plates to guide the pivoting sear safety linkage to engage said bolt sear in response to actuation of said thumb safety lever;

a first stage movement adjustment for said rocker; and a second stage length adjustment for said trigger sear.

2. The drop-in adjustable trigger assembly of claim 1, wherein said pivotable sear safety linkage incorporates an upper camming surface which, upon actuation, pivots the bolt sear to disengage the bolt sear latching end from the trigger sear.

3. The drop-in adjustable trigger assembly of claim 2, wherein said first stage movement adjustment for said rocker comprises a rocker adjustment screw mounted in said trigger bracket to move the rocker up and down to change its mechanical advantage when bearing against the trigger sear.

4. The drop-in adjustable trigger assembly of claim 2, wherein said second stage length adjustment comprises a control set screw which is threaded into a bore in the upper end of said trigger bracket to define a surface to push on the uppermost end of said trigger sear to pivot it away from said bolt sear to set the actuation sensation of said trigger assembly.

5. The drop-in adjustable trigger assembly of claim 1 wherein said first stage movement adjustment for said rocker comprises user adjustable controls for a first stage weight of pull and a first stage travel or movement range.

6. The drop-in adjustable trigger assembly of claim 1, wherein said second stage length adjustment for said trigger sear comprises user adjustable controls for second stage break weight and second stage engagement length.

7. The drop-in adjustable trigger assembly of claim 6, wherein said first stage movement adjustment for said rocker comprises user adjustable controls for a first stage weight of pull and a first stage travel or movement range.

8. The drop-in adjustable trigger assembly of claim 7, wherein said first stage weight for said trigger assembly is adjustable by a rocker set screw independently of said first stage length of travel.

9. The drop-in adjustable trigger assembly of claim 8, wherein said first stage of length of travel is controlled by a rocker adjustment screw to move the rocker along the trigger bracket to change its mechanical advantage.

10. The drop-in adjustable trigger assembly of claim 9, wherein said second stage weight is adjusted by a spring and adjustment screw to adjustably oppose the rotation of the trigger bracket when the trigger is actuated.

11. The drop-in adjustable trigger assembly of claim 10, wherein said second stage length of engagement is adjusted by a control set screw which is threaded into a bore in the upper end of said trigger bracket, said control set screw defining a distal surface to push on an uppermost end of said trigger sear to pivot it away from said bolt sear to set an actuation sensation of said trigger assembly.

12. The drop-in adjustable trigger assembly of claim 11, wherein said second stage weight is adjusted by a spring engaging said trigger bracket.

13. The drop-in adjustable trigger assembly of claim 7, wherein said second stage weight is adjusted by a spring engaging said trigger bracket.

14. A drop-in adjustable trigger assembly configured to selectively engage or release a firearm's bolt sear, comprising:

a drop-in housing including a first side-plate and a second side-plate;

a pivoting, spring-biased bolt sear engaging member movably suspended between said first side-plate and said second side-plate;

a pivoting, spring-biased trigger sear member movably suspended between said first side-plate and said second side-plate;

a pivoting, camming safety linkage movably suspended between said first side-plate and said second side-plate, said camming safety linkage being configured with a lower pivot pin and an upper pivot pin to selectively move between a safe position and a fire position and to selectively engage or disengage said bolt sear engaging member and said trigger sear member;

wherein said camming safety linkage is configured to selectively block the bolt sear engaging member's movement when in said safe position, keeping said bolt sear engaging member rigidly locked against the firearm's bolt sear while simultaneously disconnecting the bolt sear engaging member from the trigger sear member.

15. The drop-in adjustable trigger assembly of claim 14, further comprising a pivoting, upwardly projecting thumb safety lever movably suspended from either said first side-plate or said second side-plate;

wherein at least one of said first side plate and said second side plate includes a sear safety linkage slot defined therein which guides said pivoting camming safety linkage lower pivot pin in response to actuation of said upwardly projecting thumb safety lever.

16. The drop-in adjustable trigger assembly of claim 15, further comprising a trigger bracket suspended between said first side date and said second side late to pivot about a pivot point and move said trigger sear surface;

wherein said trigger bracket carries an adjustable rocker having a movement range adjustment.

17. The drop-in adjustable trigger assembly of claim 16, wherein said pivoting safety mechanism's safety linkage pivots to push upon or cam the bolt sear away from the trigger sear member, thus disengaging the bolt sear from the trigger sear member.

18. The drop-in adjustable trigger assembly of claim 16, wherein said trigger bracket's adjustable rocker has a first stage movement range adjustment and a second stage length of pull adjustment.

19. The drop-in adjustable trigger assembly of claim 18, wherein said trigger bracket's adjustable rocker is adjustable to change the mechanical advantage against said trigger sear member during the second stage of trigger bracket travel, thereby adjusting the second stage pull weight.

20. The drop-in adjustable trigger assembly of claim 19, wherein said trigger bracket bears against a plunger and biasing spring with a biasing spring pre-load adjustment configured to provide a first stage pull weight adjustment;

wherein the trigger assembly is configured to provide an adjustable first stage length of pull, an adjustable first stage pull weight, an adjustable second stage length of pull and an adjustable second stage pull weight; and wherein the total pull weight is the sum of the first stage pull weight and the second stage pull weight, and wherein said total pull weight is adjustable to a selected total weight in the range of eight ounces to three and one half pounds.

* * * * *

UNITED STATES PATENT AND TRADEMARK OFFICE

CERTIFICATE OF CORRECTION

PATENT NO. : 9,267,750 B1
APPLICATION NO. : 14/462348
DATED : February 23, 2016
INVENTOR(S) : Tubb It is certified that error appears in the above-identified patent and that said Letters Patent is hereby corrected as shown below:

In the Claims:

In claim 16, column 14 line 46 reads:

"first side date and said second side late to pivot about a pivot"

It should read:

"first side plate and said second side plate to pivot about a pivot"

Signed and Sealed this
Twenty-eighth Day of June, 2016

Michelle K. Lee

Michelle K. Lee
*Director of the United States Patent and Trademark Office*